US009523207B2

(12) United States Patent
Weber

(10) Patent No.: US 9,523,207 B2
(45) Date of Patent: Dec. 20, 2016

(54) METHOD AND APPARATUS FOR ADJUSTABLE POST-TENSIONING OF CONCRETE

(71) Applicant: Mark E. Weber, Coconut Creek, FL (US)

(72) Inventor: Mark E. Weber, Coconut Creek, FL (US)

( * ) Notice: Subject to any disclaimer, the term of this patent is extended or adjusted under 35 U.S.C. 154(b) by 220 days.

(21) Appl. No.: 14/311,651

(22) Filed: Jun. 23, 2014

(65) Prior Publication Data

US 2015/0300033 A1 Oct. 22, 2015

Related U.S. Application Data

(60) Provisional application No. 61/815,147, filed on Apr. 23, 2013.

(51) Int. Cl.
*E04G 23/02* (2006.01)
*E04C 5/00* (2006.01)

(52) U.S. Cl.
CPC ..... *E04G 23/02* (2013.01); *E04G 23/0203* (2013.01); *E04G 23/0214* (2013.01); *E04G 23/0218* (2013.01); *E04C 5/00* (2013.01)

(58) Field of Classification Search
CPC ..... E04G 23/0214; E04G 23/0203; E04G 23/0218; E05C 5/00; E01C 7/147
See application file for complete search history.

(56) References Cited

U.S. PATENT DOCUMENTS 5,115,622 A * 5/1992 Ammann ..... E04G 23/0218 52/231
5,476,340 A * 12/1995 Contrasto ..... E01C 7/147 264/35
5,771,557 A * 6/1998 Contrasto ..... E01C 7/147 264/36.2
5,906,466 A * 5/1999 Eandi ..... E04F 13/0837 411/531

(Continued)

OTHER PUBLICATIONS http://www.torque-lock.com/ Available: Apr. 6, 2007.*
Structural Crack Repair with Torque Lock Staples. (n.d.). Retrieved Jun. 23, 2014, from https://www.torque-lock.com/.

*Primary Examiner* — Andrew J Triggs
(74) *Attorney, Agent, or Firm* — Dunlap Bennett & Ludwig PLLC

(57) ABSTRACT

A tensioning device and method for post-tensioning a concrete member having at least one crack is provided. The tensioning device may include an elongated body, a stitch catch arm and an anchor. The catch arm may be perpendicularly joined to one end of the elongated body, wherein the catch arm is inserted into a hole in the concrete member. The elongated body may form an anchor recess therein, wherein an anchor interface surface is defined by the anchor recess. The anchor interface may form an anchor aperture for receiving the anchor. The thickness of the anchor interface may uniformly decrease as the anchor interface extends toward the catch arm end of the anchor recess so that when ratcheting the anchor into the concrete member and onto the anchor interface a portion of the applied compressive force and/or torque may be transformed into an axial force along the elongated body so as to provide post-tensioning through the tensioning device and across the at least one crack.

14 Claims, 4 Drawing Sheets

(56) References Cited

U.S. PATENT DOCUMENTS

| | | | | |
|---|---|---|---|---|
| 6,145,260 | A * | 11/2000 | Morton | E04G 23/0218 52/293.2 |
| 6,355,038 | B1 * | 3/2002 | Pisharodi | A61B 17/7043 411/538 |
| 6,532,714 | B1 * | 3/2003 | Ferm | E01C 7/147 404/64 |
| 7,513,024 | B2 * | 4/2009 | Keller | B23P 6/04 29/402.09 |
| 7,574,840 | B1 * | 8/2009 | Fyfe | E02D 27/42 52/223.13 |
| 7,743,585 | B2 * | 6/2010 | Wheatley | E04G 23/0218 52/347 |
| 9,290,957 | B1 * | 3/2016 | Wheatley | E04C 5/07 |
| 2002/0062618 | A1 * | 5/2002 | Pourtier | F16B 13/045 52/698 |
| 2007/0050963 | A1 * | 3/2007 | Keller | B23P 6/04 29/402.12 |
| 2010/0316465 | A1 * | 12/2010 | Gillis | F16B 13/002 411/29 |
| 2013/0008111 | A1 * | 1/2013 | Wu | E04G 23/0218 52/309.17 |
| 2013/0008120 | A1 * | 1/2013 | Wu | E04G 23/0218 52/698 |
| 2015/0068154 | A1 * | 3/2015 | Merlob | E04G 23/0218 52/741.1 |
| 2015/0300033 | A1 * | 10/2015 | Weber | E04G 23/0203 52/514 |

* cited by examiner

METHOD AND APPARATUS FOR ADJUSTABLE POST-TENSIONING OF CONCRETE

CROSS-REFERENCE TO RELATED APPLICATION

This application claims the benefit of priority of U.S. provisional application No. 61/815,147 filed 23 Apr. 2013, the contents of which are herein incorporated by reference.

BACKGROUND OF THE INVENTION

The present invention relates to concrete crack repair and, more particularly, to a method and apparatus for low-profile concrete post-tensioning when restoring tensile strength in a cracked concrete section.

Concrete serves as the primary material in the construction of foundations, columns, beams and load-carrying slabs. Unfortunately, concrete can crack during its lifetime for several common reasons, such as shrinkage, thermal expansion and contraction, low tensile strength and the like. Non-reinforced cracks or fractures cannot transfer loads from one slab section to the adjacent slab section, and so is in need of repair.

Repair of fractured concrete, to be successful, often needs additional steel placed in tension to provide structural stability by transferring the tensile load. Conventional methods for structural crack repair options included: doweling, epoxy injection, adding "U" clip reinforcement, and post-tensioning.

Doweling consists of drilling holes and anchoring straight steel dowels across the crack. The straight steel is anchored with epoxy to solid areas of reinforced concrete. However, doweling is often impractical for typical slab thicknesses of 8 inches or less. Also, doweling is known to be not very effective for restoring tension in flexural members.

Epoxy injection makes the injected crack stronger than the adjacent concrete. If active cracks are injected, new cracks can form next to or far away from the repaired crack unless one employs sufficient amounts of tensioned reinforcing. Moreover, often times the epoxy and concrete interface separates—bond separation—under loading. As a result, bond separation of the epoxy, like the original cracking it aimed to repair, cannot help to bear the load across the fracture.

By adding "U" clip reinforcement, cracked concrete is repaired with reinforcing bars or metal "U" clips. Concrete crack repair by this option is done by drilling holes or slots across the crack plane. The reinforcing bars are not placed in tension and are glued in across the crack in the slot or drilled holes. Although adding reinforcing over a crack adds strength to the region, the crack has to re-form before it resists tension. Also, with many conventional and employable methods of repair, cracking had to occur over the repaired area before added reinforcement could resist movement. Although post-tensioning is often recommended as the best choice to repair fractured concrete, it often cannot be applied since the tensioning mechanism would reside above the concrete surface and inhibit future use of the slab. Post-tensioning is a good concrete crack repair solution when a major portion of a member must be strengthened or when a crack must be closed. Post-tensioning—strands or bars are used to apply compressive force to the ailing member. Employing this method calls for adequate anchorage for the post-tensioning steel as well as to balance the effect of the tensioning force and eccentricity on stresses in the structure. As a result, utilizing this method often involves a very large (high profile) mechanism that significantly protrudes from the surface of the fractured member.

As can be seen, there is a need for an improved low-profile method and apparatus for repairing or improving load transfer across cracks in concrete as well as for resisting future cracking.

SUMMARY OF THE INVENTION

In one aspect of the present invention, a tensioning device for post-tensioning concrete members have at least one crack, comprising: an elongated body having a first surface and a second surface, wherein the first surface and the second surface extend from an anchor end to an opposing catch arm end; an anchor interface surface provided by the first surface, wherein the distance from the anchor interface surface to the second surface uniformly decreases as the anchor interface surface extends in the direction of the catch arm end; an anchor aperture formed within the anchor interface surface; and a stitch catch arm perpendicularly joined to the catch arm end.

In another aspect of the present invention, a method of post-tensioning a concrete member having at least one crack, comprising: providing a tensioning device comprising: an elongated body defined by a first surface and an opposing second surface, wherein both surfaces extend from an arm end to an opposing end; an anchor interface surface provided by the first surface, wherein the distance from the anchor interface surface to the second surface decreasing as the anchor interface surface extends in the direction of the arm end; an anchor aperture defined by the anchor interface surface; and a stitch catch arm perpendicularly joined to the arm end; providing an anchor having a threaded portion for receiving a nut; drilling a catch hole and an anchor hole on opposing sides of the at least one crack, wherein the catch hole and the anchor hole correspond to the disposition of the stitch catch arm and the anchor aperture, respectively; verifying the catch hole and the anchor hole are of proper depth; inserting the catch arm into the catch hole so that the anchor aperture generally circumscribes the anchor hole; inserting the anchor through the anchor aperture and into the anchor hole; tapping the tensioning device so that the elongated head is generally flush with the surface of the concrete member; and tightening the nut onto the anchor interface so that the anchor and catch arm are sufficiently inserted, and wherein a portion of the resulting torque is transferred to an axial force along the elongated body, whereby post-tensioning along the tensioning device and across the at least one crack.

These and other features, aspects and advantages of the present invention will become better understood with reference to the following drawings, description and claims.

DETAILED DESCRIPTION OF THE INVENTION

Figure 1:
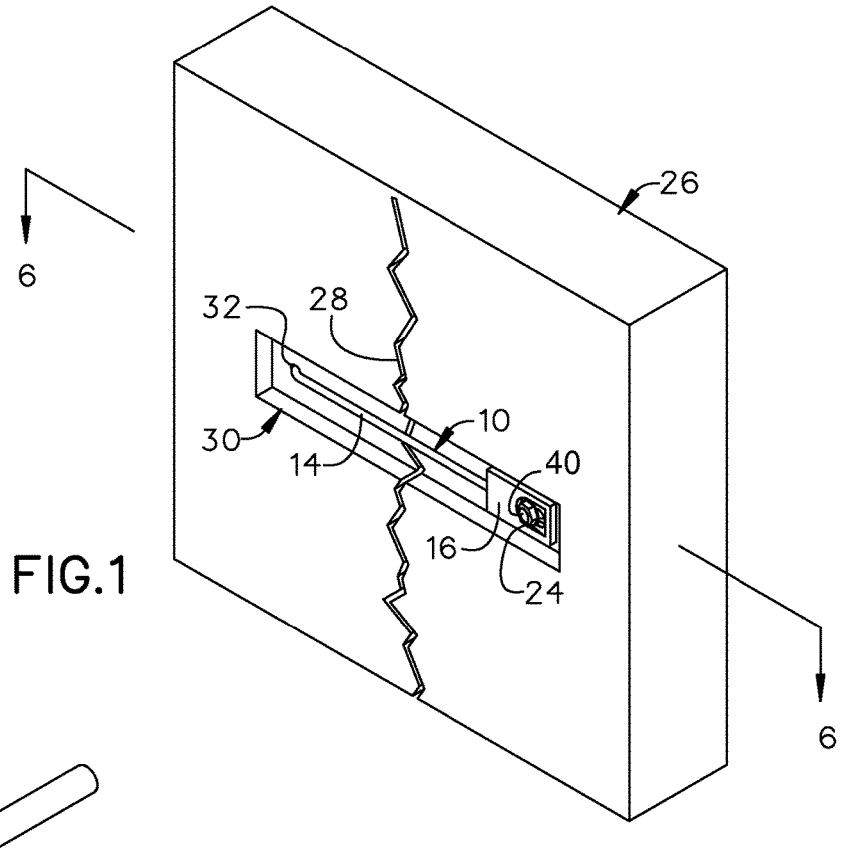
FIG. 1 is a perspective view of an exemplary embodiment of the present invention, illustrating use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tensioning device and method for post-tensioning a concrete member having at least one crack. The tensioning device may include an elongated body, a stitch catch arm and an anchor. The catch arm may be perpendicularly joined to one end of the elongated body, wherein the catch arm is inserted into a hole in the concrete member. The elongated body may form an anchor recess therein, wherein an anchor interface surface is defined by the anchor recess. The anchor interface may form an anchor aperture for receiving the anchor. The thickness of the anchor interface may uniformly decrease as the anchor interface extends toward the catch arm end of the anchor recess so that when ratcheting the anchor into the concrete member and onto the anchor interface a portion of the applied compressive force and/or torque may be transformed into an axial force along the elongated body so as to provide post-tensioning through the tensioning device and across the at least one crack.

Referring to FIGS. 1 through 7, the present invention may include an adjustable tensioning device 10 for repairing a concrete member 26. The tensioning device 10 may include a stitch bridge 14, an elongated body 16 and an anchor 40. The stitch bridge 14 may terminate in a perpendicular stitch catch arm 12. The tensioning device 10 may be made of material capable of carrying the designed-for structural loads to be transferred. The tensioning device 10 may be coated to resist corrosion. In certain embodiments, the tensioning device 10 may be made of material capable of bonding to both adhesives and concrete and that is corrosion-resistant, such that the tensioning device 10 will resist corrosion from any moisture that may seep into through the concrete member 26.

The elongated body 16 may include a first surface 62 and a second surface 64 that sandwich a generally rectangular block. The generally rectangular block may have a catch arm end 66 and an opposing anchor end 68. The block-like elongated body 16 may form an anchoring recess 19 therein. A portion of the anchoring recess 19 may include an angled anchor interface surface 20 having a wedge-like shape, whereby the distance from the surface of the anchor interface surface 20 to the second surface uniformly decreases as the surface of the anchor interface surface 20 extends from the anchor end 68 of the recess 19 toward the catch arm end 66 of the recess 19. The anchor interface surface 20 may define an anchor aperture 18. In certain embodiments, the anchor interface surface 20 may be provided by the first surface 62 absent the anchoring recess 19.

The slanted anchor interface surface 20 may be adapted to transform the compressive force and/or torque of tightening the anchor 40 on the anchor interface surface 20 to an axial force along the elongated body 16, thereby post-tensioning along the stitch bridge 14 so as to create a load path for tension to travel across the affected area of the at least one crack 28 and into the unaffected reinforced areas of the concrete member 26. In certain embodiments, the nut 24 on the threaded anchor 40 slides down the anchor interface surface 20 as the anchor 40 is drawn down into the concrete member 26. When the anchor 40 is further inserted by proper tightening, an axial force is applied along the elongated body 16. As a function of geometry (i.e., the angle of the wedge-like anchor interface 20) a portion of the applied force vector is translated from the axis of the threaded anchor 40 and along the stitch bridge 14, placing the anchor 40 and the stitch catch arm 12 in tension and applying force along the tensioning device 10 and across the at least one crack 28.

In an alternative embodiment, the elongated body 16 may define the anchor aperture 18 without the anchor interface 20. A disc may be sized to fit within such anchor aperture 18. A pin could be perpendicularly attached to the disc off-center, such that when the disc is rotated it creates a cam effect or otherwise transforming rotary motion into linear motion and applying force along the tensioning device 10 and across the at least one crack 28.

The anchor 40 may include an expandable sleeve 22 and a nut end for receiving a nut 24. In certain embodiments, the anchor 40 provides a known means of applying compressive force thereto for securing in a concrete member 26. The nut end may include threading for securely mating with the nut 24. The expandable sleeve 22 may include an outwardly flared cone-shaped end opposite the nut end. The cone-shaped end may be adapted so that tightening of the nut 24 pulls the cone-shaped stud end into the expandable sleeve 22, thereby expanding the cross-section of the anchor 40 so as to adjustably secure to the concrete member 26. In certain embodiment, the anchor 40 may be rigidly secured within the concrete member 26.

Figure 2:
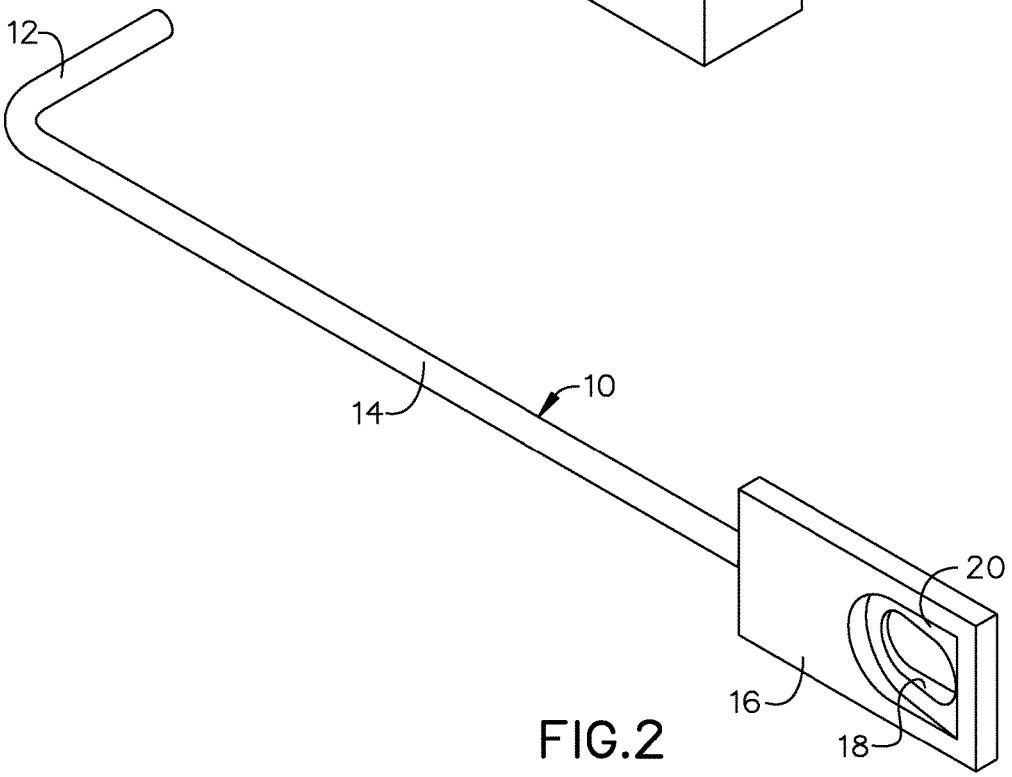
FIG. 2 is a perspective view of an exemplary embodiment of the present invention.
Figure 3:
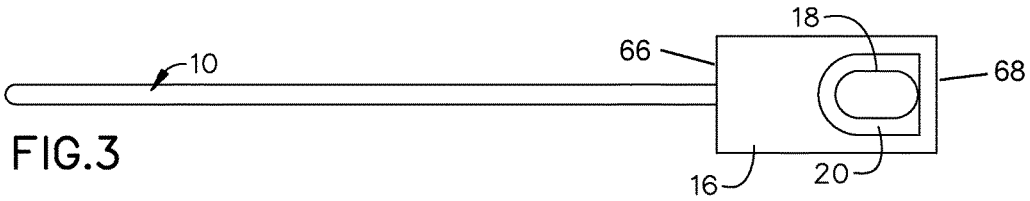
FIG. 3 is a front view of an exemplary embodiment of the present invention.
Figure 4:
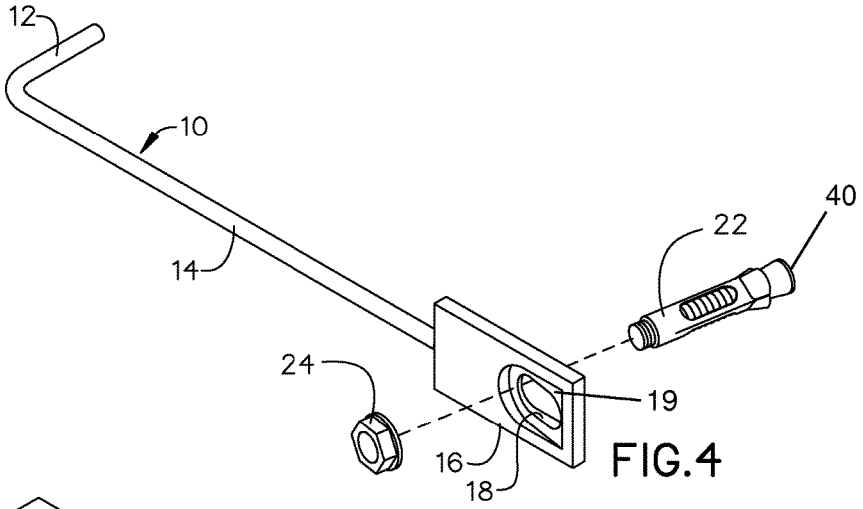
FIG. 4 is an exploded view of an exemplary embodiment of the present invention.
Figure 5:
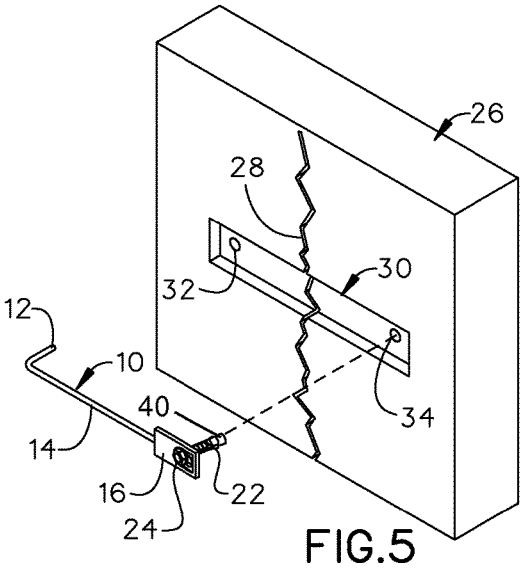
FIG. 5 is an exploded view of an exemplary embodiment of the present invention, illustrating use.
Figure 6:
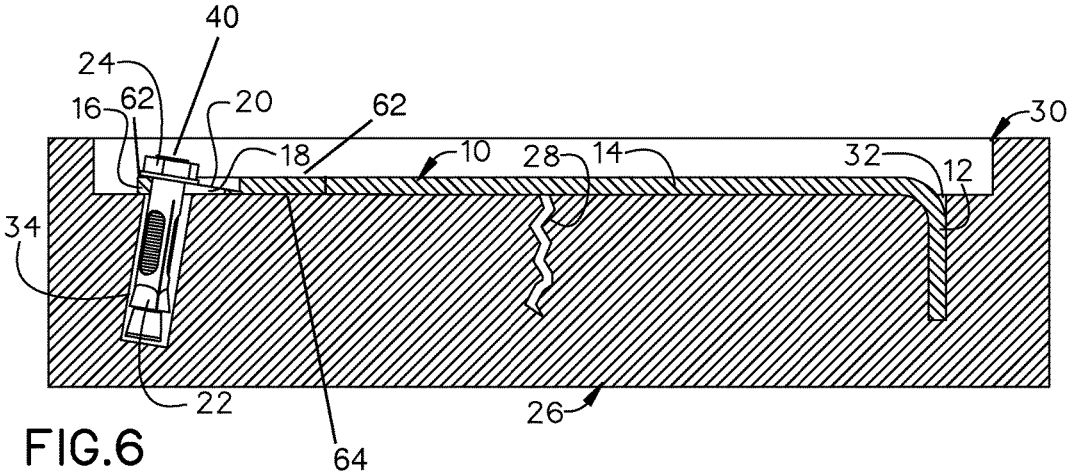
FIG. 6 is a section view is an exemplary embodiment of the present invention shown along line 6-6 in FIG. 1, illustrating an application of the exemplary embodiment of the present invention prior to applying post-tensioning forces.
Figure 7:
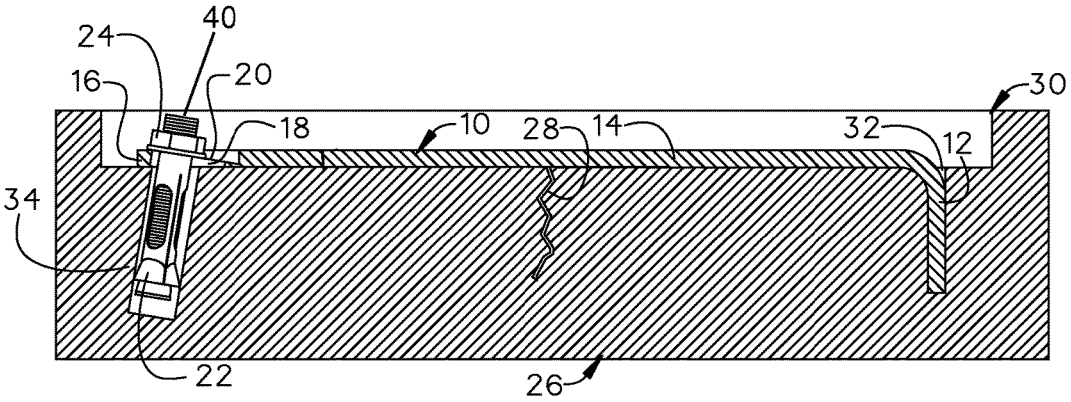
FIG. 7 is a section view is an exemplary embodiment of the present invention shown along line 6-6 in FIG. 1, illustrating an application of the exemplary embodiment of the present invention after applying post-tensioning forces.

The catch arm end 66 of the elongated body 16 may be joined to a first end of the stitch bridge 14 in a relatively parallel position; the opposing second end of the stitch bridge 14 may be perpendicularly joined to the stitch catch arm 12, as illustrated in FIG. 2. In certain embodiments, the stitch bridge 14 and the catch arm 12 are the same member, such as, but not limited to, rebar steel whose end is bent to form the catch arm 12.

In an alternative embodiment, the tensioning device 10 may have a pair of opposing elongated bodies 16, whereby the additional elongated body 16 replaces a portion of the stitch bridge 14. Such alternative embodiment may include two anchors 40, whereby the additional anchor 40 replaces the catch arm 12 for attaching to the concrete member 26.

In an alternative embodiment, the elongated body 16 may extend up until the stitch catch arm 12, obviating the need for the horizontal element of the stitch bridge 14. The resulting catch arm end 66 would be perpendicularly joined directly to the catch arm 12 or joined in parallel to the additional opposing elongated body 16 disclosed immediately above.

Figure 8:
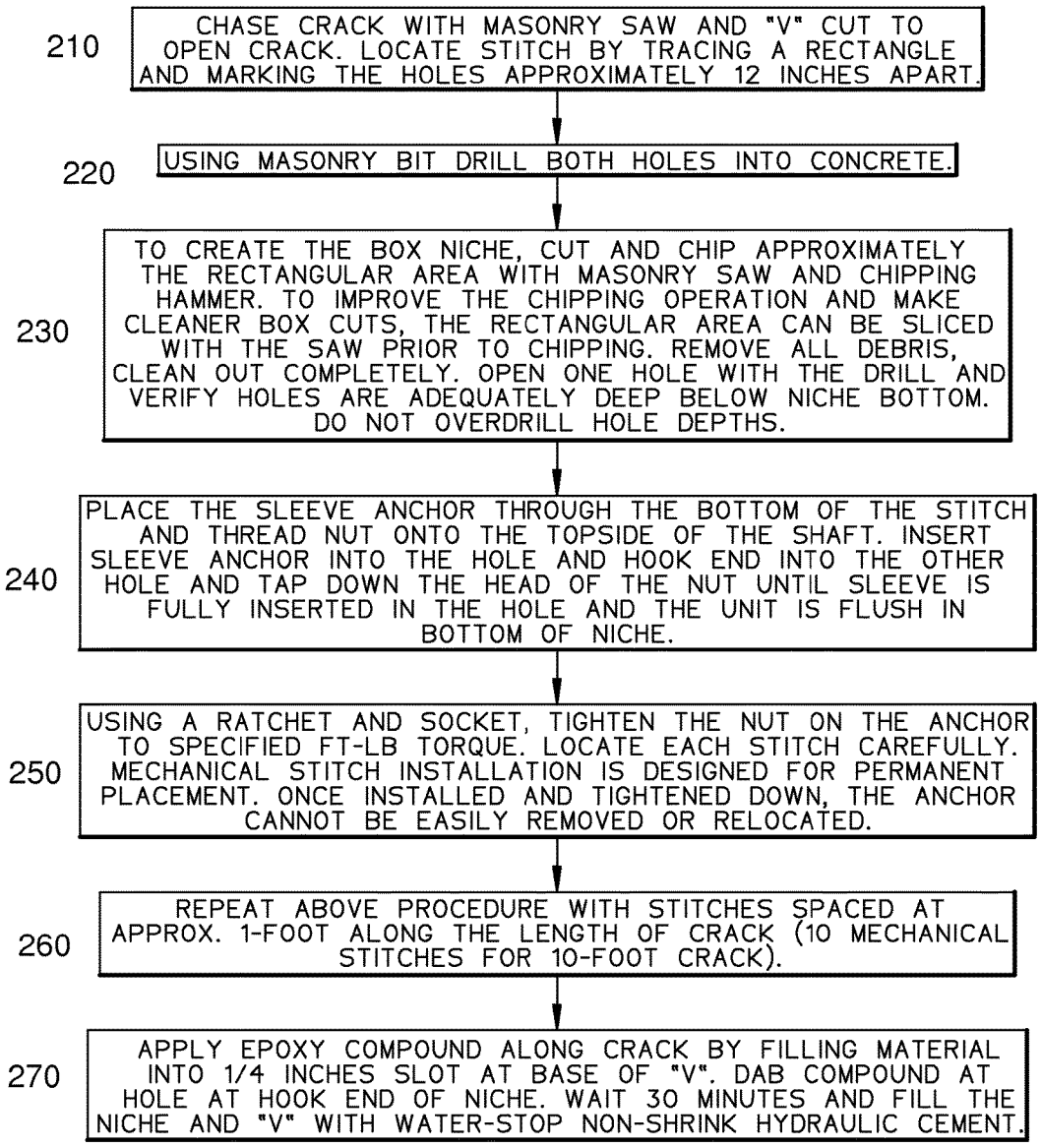
FIG. 8 is a flowchart demonstrating an application of an exemplary embodiment of the present invention.

Referring to FIG. 8, the method of using the present invention may include the following. The tensioning device 10 disclosed above may be provided. The initial step of a method of post-tensioning at least one crack 28 in the concrete member 26 may include opening or chasing the at least one crack 28 with, in certain embodiments, a masonry saw so as to "V" cut the at least one crack 28, in step 210. In certain embodiments, the "V" cut may be approximately ¾" in width. Then a user may locate placement of the tensioning device 10 by tracing tensioning device 10 shape and marking a catch hole 32 and an anchor hole 34 on each side of the at least one crack 28 that coordinates with the stitch catch arm 12 and the anchor aperture 18, respectively. In certain embodiments, the catch hole 32 and the anchor hole 34 may be approximately 12 inches apart. In step 400, the user may drill the catch hole 32 and the anchor hole 34 to a proper depth in the concrete member 26 by, in certain embodiments, a masonry drill.

The user may then create a box groove 30 to facilitate the seating of the tensioning device 10, in step 220. The box groove 30 may be made to accommodate tensioning devices 10 of various sizes, shapes and dimensions. The box groove 30 may be made by cutting and chipping an approximately rectangular area into the concrete member 26 symmetrically about the at least one crack 28. The cutting and chipping of the concrete member 26 may be done with the masonry saw and a chipping hammer, respectively. In certain embodiments, to improve the chipping operation and make a cleaner box groove 30, the box groove 30 may be sliced with the masonry saw prior to the chipping. Then the user may remove all the debris and verify the proper depths of the catch hole 32 and the anchor hole 34.

The user may then place the stitch catch arm 12 into the catch hole 32 so that the second surface 64 is generally parallel to the surface of the concrete member 26 and so that the anchor aperture 18 approximately circumscribes the anchor hole 34, in step 240. Then the user may position the anchor 40 through the anchor aperture 18 and into a portion of the anchor hole 34. Then the user may partially thread the nut 24 onto the protruding nut end of the anchor 40. The user may then tap the nut 24, the stitch catch arm 12 and/or the first surface 62 until the second surface 64 is approximately flush with the top surface of the box groove 30.

Using a ratcheting means, the user may tighten the nut 24 on the anchor 40 to a predetermined ft-lb torque, in step 250, thereby providing post-tensioning across the at least one crack 28. The ratcheting means may include commonly available ratchet and socket and the like. The predetermined ft-lb torque may be adjusted and set for several different purpose, including tension transfer or restoration, resisting future cracking, proper positioning, effective and/or engagement with the concrete member 26.

In step 260, the user may repeat steps 210 through 250 with additional tensioning devices 10, as needed.

The user may apply epoxy compound or the like along the at least one crack 28, in step 270. In certain embodiments, by filling the base of the "V" cut with a plurality of ¼" slots. The user may dab the epoxy compound in the catch hole 32; waiting approximately 30 minutes, and filling the box groove 30 with water-stop non-shrink hydraulic cement, polymer concrete or the like.

It should be understood, of course, that the foregoing relates to exemplary embodiments of the invention and that modifications may be made without departing from the spirit and scope of the invention as set forth in the following claims.

What is claimed is:

1. A tensioning device for post-tensioning a concrete member having at least one crack, comprising:

an elongated body having a first surface and a second surface, wherein the first surface and the second surface extend from an anchor end to an opposing catch arm end;

an anchor interface surface provided by the first surface, wherein a distance from the anchor interface surface to the second surface uniformly decreases as the anchor interface surface extends in a direction of the catch arm end;

an anchor aperture formed within the anchor interface surface; and a stitch catch arm perpendicularly joined to the catch arm end.

2. The tensioning device of claim 1, wherein the anchor interface surface is disposed near the anchor end.

3. The tensioning device of claim 1, further including an anchor recess formed within a portion of the first surface, wherein the anchor recess circumscribes the anchor interface surface.

4. The tensioning device of claim 1, further including a stitch bridge joined between the stitch catch arm and the catch arm end of the elongated body.

5. The tensioning claim of 4, wherein the stitch catch arm and the stitch bridge is a unitary member.

6. The tensioning claim of 5, wherein the unitary member is a rebar steel.

7. The tensioning device of claim 1, further including an anchor having a threaded portion for receiving a nut.

8. The tensioning device of claim 7, further including an expandable sleeve provided by the anchor.

9. A tensioning device for post-tensioning a concrete member having at least one crack, comprising:

an elongated body having a first surface and an opposing second surface, wherein the first surface second surfaces extend from an anchor end to an opposing catch arm end;

a wedge-shaped anchor interface surface formed by the first surface, wherein a distance from the anchor interface surface to the second surface decreases as the anchor interface surface tapers toward the catch arm end;

an anchor aperture formed within the anchor interface surface; and a stitch catch arm perpendicularly joined to the catch arm end.

10. The tensioning device of claim 9, wherein the anchor interface surface is disposed near the anchor end.

11. The tensioning device of claim 9, further including an anchor recess formed within a portion of the first surface, wherein the anchor recess circumscribes the anchor interface surface.

12. The tensioning device of claim 9, further including a stitch bridge joined between the stitch catch arm and the catch arm end of the elongated body.

13. The tensioning claim of 12, wherein the stitch catch arm and the stitch bridge is a unitary member.

14. The tensioning claim of 13, wherein the unitary member is a rebar steel.

* * * * *